United States Patent [19]

Abate

[11] Patent Number: 5,033,667

[45] Date of Patent: Jul. 23, 1991

[54] SHEETING WEB CONSISTING OF FOLDABLE MATERIAL, PREFERABLY PAPER OR CARDBOARD, FOR CONTINUOUS PACKAGING OF A PRODUCT, PREFERABLY A LIQUID

[75] Inventor: Alessandro Abate, Mercogliano, Italy

[73] Assignee: Italpack s.r.l., Mercogliano, Italy

[21] Appl. No.: 407,536

[22] Filed: Sep. 15, 1989

[30] Foreign Application Priority Data

Jun. 5, 1989 [IT] Italy ..... 4836 A/89

[51] Int. Cl.[5] ..... B65D 00/00

[52] U.S. Cl. ..... 229/125.42; 229/137

[58] Field of Search ..... 229/3.1, 137, 125.42, 229/198.2; 206/621.1, 621.2, 631.3

[56] References Cited

U.S. PATENT DOCUMENTS

| | | | |
|---|---|---|---|
| 2,218,670 | 10/1940 | Bennett | 206/621.1 |
| 2,360,439 | 10/1944 | Monroe | 206/621.2 |
| 2,576,595 | 11/1951 | Goldstein | 206/621.2 |
| 3,495,507 | 2/1970 | Haas et al. | 229/137 |
| 3,604,317 | 9/1971 | Bonn | 229/3.1 |
| 4,192,446 | 3/1980 | Naito | 229/137 |
| 4,655,386 | 4/1987 | Billberg | 229/3.1 |
| 4,802,620 | 2/1989 | Phillips | 229/3.1 |
| 4,842,906 | 6/1989 | Ekdahl et al. | 229/621.2 |
| 4,891,929 | 1/1990 | Branchi . | |

FOREIGN PATENT DOCUMENTS

| | | | |
|---|---|---|---|
| 1289481 | 2/1969 | Fed. Rep. of Germany | 206/631.3 |
| 2721390 | 11/1978 | Fed. Rep. of Germany | 229/3.1 |
| 7804821 | 11/1978 | Netherlands | 206/621.2 |
| 205383 | 6/1966 | Sweden | 229/125.42 |

*Primary Examiner*—Gary E. Elkins

*Attorney, Agent, or Firm*—Dilworth & Barrese

[57] ABSTRACT

A sheeting web consisting of foldable material, preferably of paper or cardboard, is described. The web enables a product, preferably a liquid, to be packaged continuously. The sheeting web has parallel spaced longitudinal edges (31, 32). Four continuous longitudinal folds (4) running parallel to the longitudinal edges (31, 32), uniformly spaced continuous first transverse folds (6, 7, 8) at right angles to the longitudinal edges (31, 32), and continuous second transverse folds (71, 8) at a given distance from and parallel to the first transverse folds (6, 7, 8) are provided, with the result that four contiguous rectangles in a transverse direction and a rectangular end strip connected to these are available. Alternate non-contiguous rectangles together with the rectangular end strip each have a third transverse fold (15, 10) running parallel to the first transverse fold (6, 7, 8) and equidistant therefrom and each have a fourth transverse fold (33, 10) running parallel to the second transverse fold (15, 10) and at the same distance as the third transverse fold from the first. The remaining two rectangles each have a central longitudinal fold (13) located in the middle of the rectangle which is shorter than the distance between the third and fourth transverse folds. Four diagonal folds (1) are provided each running from the two opposite ends of the central longitudinal fold (13) to the two nearest corners of the respective rectangle. Four rectangles, and also four inclined folds (12) are provided each running from the two ends of the central longitudinal fold (13) to the nearest intersection of the third and fourth transverse folds with the longitudinal folds (4) in the other rectangles or the end strip (FIG. 5).

11 Claims, 5 Drawing Sheets

SHEETING WEB CONSISTING OF FOLDABLE MATERIAL, PREFERABLY PAPER OR CARDBOARD, FOR CONTINUOUS PACKAGING OF A PRODUCT, PREFERABLY A LIQUID

BACKGROUND OF THE INVENTION

1. Field of the Invention

The present invention relates to a sheeting web consisting of foldable material, preferably paper or cardboard, for continuous packaging of a product, preferably a liquid.

2. Description of the Prior Art

The process of packaging goods, preferably liquids, in prefabricated containers is known in the art. There is a need, however, to be able to package a product, particularly in liquid form, continuously. To this end, it is necessary to form the containers from a continuous sheeting web and then to singulate them.

In accordance with the present invention a container of this type can be achieved by means of a sheeting web, consisting of foldable material, preferably paper or cardboard, for continuous packaging of a product, preferably a liquid. The web includes parallel spaced longitudinal edges, four continuous longitudinal folds running parallel to the longitudinal edges, uniformly spaced continuous first transverse folds at right angles to the longitudinal edges, and continuous second transverse folds at a given distance from, and parallel to the first transverse folds, with the result that four contiguous rectangles in a transverse direction and a rectangular end strip connected to these are provided. Where one of and the next-but-one of these rectangles together with the rectangular end strip, each have a third transverse fold running parallel to the first transverse fold and equidistance from it and each have a fourth transverse fold running parallel to the second transverse fold and at the same distance as the third transverse fold from the first. The remaining two noncontiguous rectangles each have a central longitudinal fold located in the middle from all directions and which is shorter than the distance between the third and fourth transverse folds. Four four diagonal folds each extend from the two ends of the central longitudinal fold to the two nearest corners of the respective rectangle. Four inclined folds each extend from the two ends of the central longitudinal fold to the nearest intersection of the third and fourth transverse folds with the longitudinal folds in the other non-contaguous rectangles or the end strip.

To form a container or a continuous container chain the sheeting web is folded along the four continuous longitudinal folds parallel to the longitudinal edges resulting in the formation of a continuous sheeting tube of rectangular cross-section. The four contiguous rectangles in a transverse direction are then folded such that they form the link zones between two container zones. The folds within these four contiguous rectangles are configured such that two opposed container top zones adjacent to the appropriate container zones and one intermediate container base zone are formed.

Advantageous improvements are described in the dependent claims. In the preferred embodiment, the sheeting web consists of a first layer of a foldable material, preferably paper or cardboard, and of a second layer of a material, preferably aluminium or plastic, compatible with the product, preferably a liquid. The first layer is the external layer in the finished product, and the second the internal layer. The second layer, therefore, comes into contact with the container contents, i.e. the product to be packaged which is preferably a liquid.

In the preferred embodiment the first layer ends in the region of a longitudinal edge of the sheeting web at a given distance from this longitudinal edge and is folded over the second layer in this region. When the sheeting web is connected at its parallel longitudinal edges to form a sheeting tube of rectangular cross-section this configuration ensures that the container contents only come into contact with the second layer intended for this contact but not with the first.

BRIEF DESCRIPTION OF THE DRAWINGS

An embodiment of the invention is described in detail below with reference to the accompanying drawings, in which.

DETAILED DESCRIPTION OF THE PREFERRED EMBODIMENTS

Figure 1:
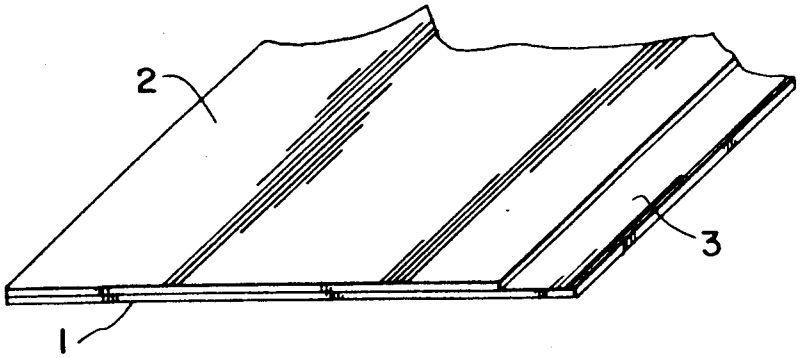
FIG. 1 shows a perspective view of a sheeting web.

The sheeting web shown in FIG. 1 consists of a first layer 2 made of a foldable material, for example paper or cardboard, and of a second layer 1 made of a material, for example aluminium or plastic, which is compatible with the liquid which is to be packaged. In the region of a longitudinal edge, the first layer 2 ends at a given distance from this longitudinal edge. This zone is designated 3 in FIG. 1. It is possible for a thin residual layer of foldable material to be left in this zone 3; this is illustrated in FIG 3.

Figure 2:
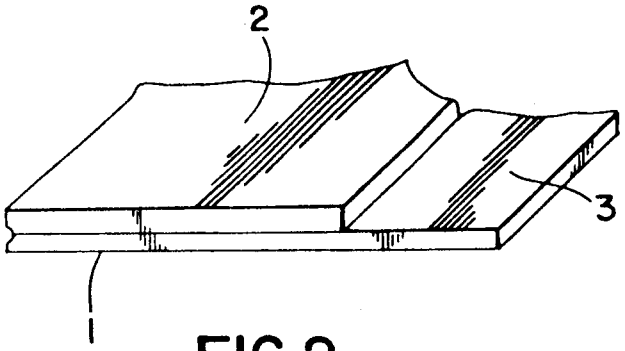
FIG. 2 shows an enlarged view of the sheeting web illustrated in FIG. 1.

FIG. 2 respresents an enlarged version of FIG. 1.

Figure 3:
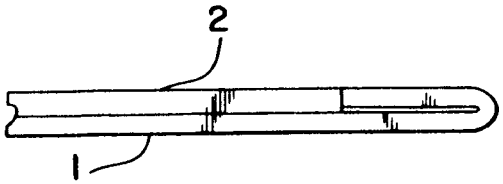
FIG. 3 shows a front view of the sheeting web with its end folded back.

In FIG. 3 the sheeting in the edge zone 3 has been folded back. As a result, the second layer 1 forms the external layer all round in this zone. In zone 3, therefore, the second layer is found both on the upper and lower layers of the sheeting web and also on the edge connnecting the upper and lower layers.

Figure 4:
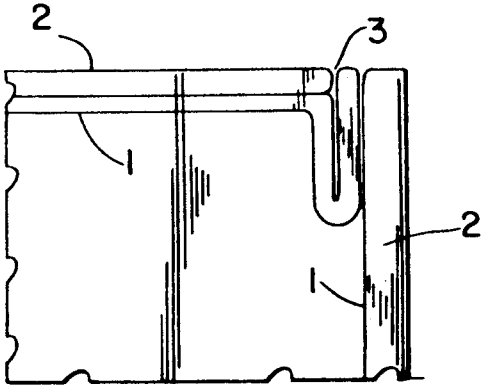
FIG 4 shows the sheeting web illustrated in FIG. 3 with the longitudinal edges connected to form a sheeting tube.

In FIG. 4 the longitudinal edges of the sheeting web are connected together to form a sheeting tube. Because the sheeting is folded back in the zone 3 of one edge as shown in FIG. 3, the liquid contained inside the sheeting tube only comes into contact with the second layer 1 but not with the first layer 2.

Figure 5:
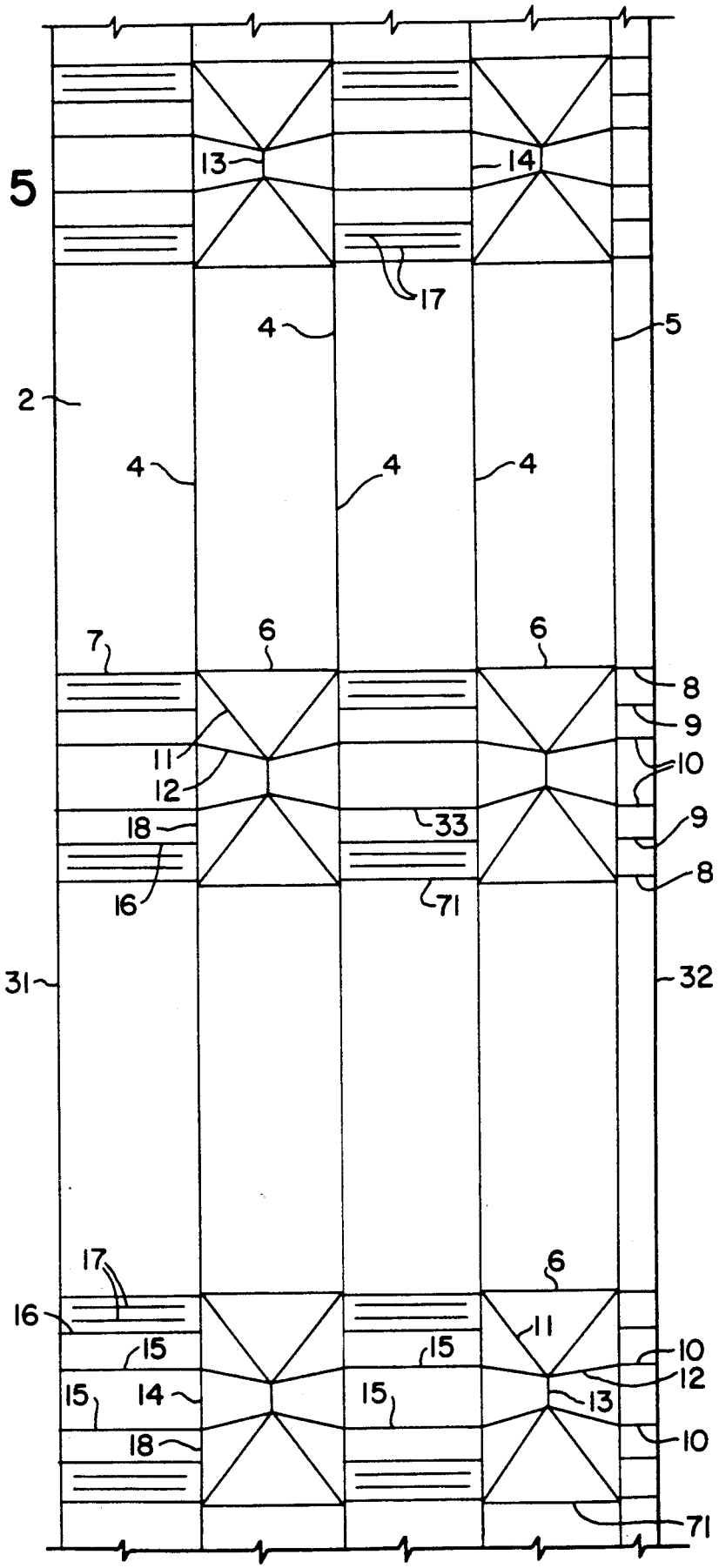
FIG. 5 shows a top view of the sheeting web.

FIG. 5 shows the sheeting web in a view from above. The lines drawn inside the sheeting web represent folds. The sheeting web has two parallel spaced longitudinal edges 31, 32. Four continuous longitudinal folds 4 run parallel to the longitudinal edges 31, 32. At right angles to the longitudinal edges 31, 32 there are continuous first transverse folds 6, 7 at uniform spacings from each other. Continuous second transverse folds 71 are provided running at a given distance from the first transverse folds 6, 7 and parallel to them. As a result of the longitudinal edges 31, 32, the longitudinal folds 4, the first transverse folds 6, 7 and the second transverse folds 71 four contiguous rectangles are formed transversely across the sheet. Further a rectangular end strip is formed contiguous with the rectangle shown to the right of the other rectangles. The rectangle shown on the left in FIG. 5, the next-but-one rectangle to its right and the rectangular end strip each have a third transverse fold 15 or 10 running parallel to the first transverse fold 6, 7 and at the same distance from it, and each have a fourth transverse fold 33 or 10 running parallel to the second transverse fold 71 and at the same distance as the third transverse fold from the first. The remaining two rectangles each have a central longitudinal fold 13 located in the middle of the rectangle as shown. This fold 13 is shorter than the distance between the third and fourth transverse folds as well as four diagonal folds 11 each running from the two ends of the central longitudinal fold 13 to the two nearest corners of these rectangles also provided are four inclined folds 12 each running from the two ends of the central longitudinal fold 13 to the nearest intersection of the third and fourth transverse folds 15 or 10 and 33 or 10 resp. with the longitudinal folds 4 in the other rectangles or the end strip. Transverse reinforcement folds and transverse folds 16, 17 are located in the first rectangles. Folds 18 form part of longitudinal folds 4.

Figure 6:
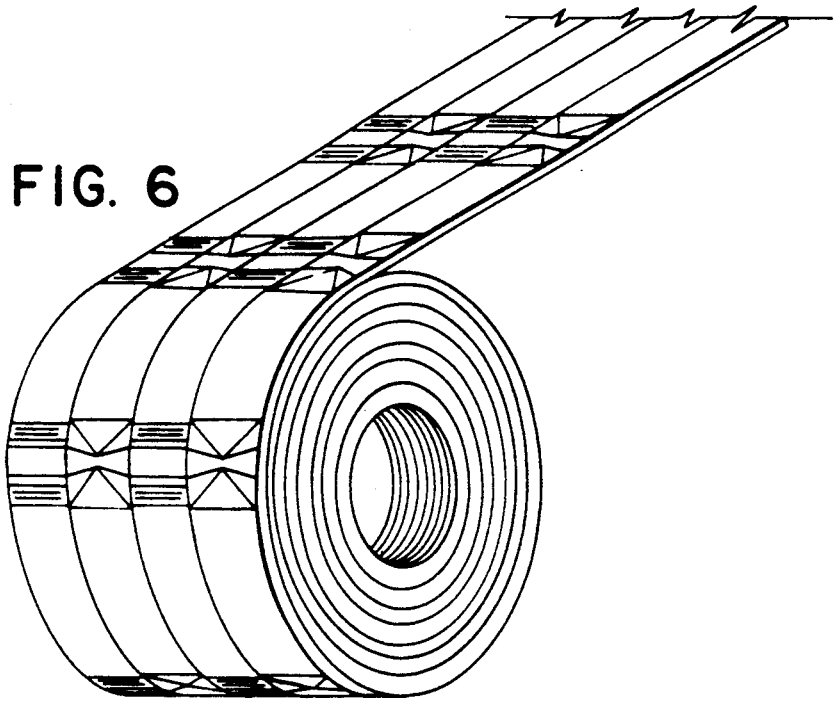
FIG. 6 shows a perspective view of the rolled-up sheeting web.

FIG. 6 shows a perspective view of the sheeting web rolled up.

Figure 7:
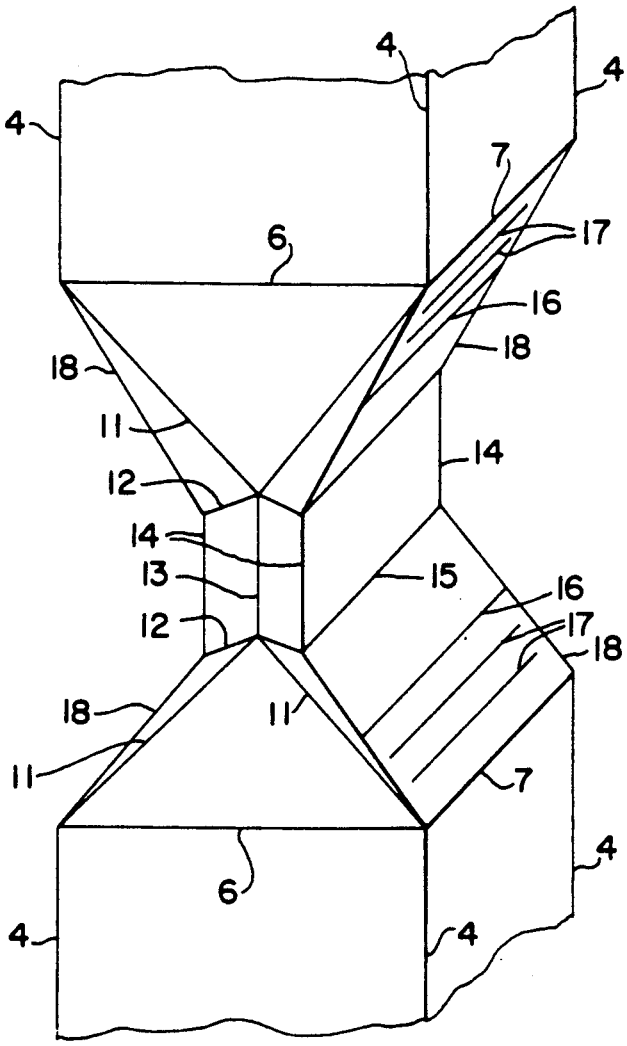
FIG. 7 shows part of the container chain formed from the sheeting web.

In FIG. 7 the longitudinal edges 31, 32 of the sheeting web are connected together to form a sheeting tube. The continuous longitudinal folds 4 form the edges of the rectangular cross-section container chain. The contiguous rectanglars form the intermediate zones between two container zones of the container chain. The folds in the rectangles are formed such that a roof-shaped end zone is connected to each container zone. The roof-shaped end zones are connected to each other at their ends by a parallel intermediate zone. As a result of the inclined folds 12 which run at an angle to the other folds it is possible to manufacture the container chain shown in FIG 7 in a continuous process.

Figure 8:
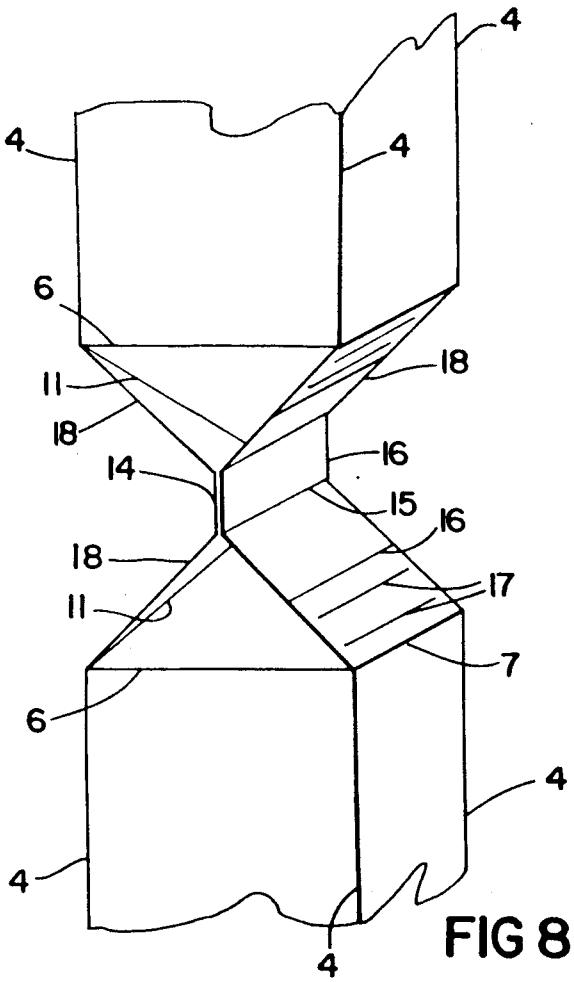
FIG 8 shows a view corresponding to that of FIG. 7.

FIG. 8 shows a view corresponding to FIG. 7 in which the intermediate zones are welded together.

Figure 9:
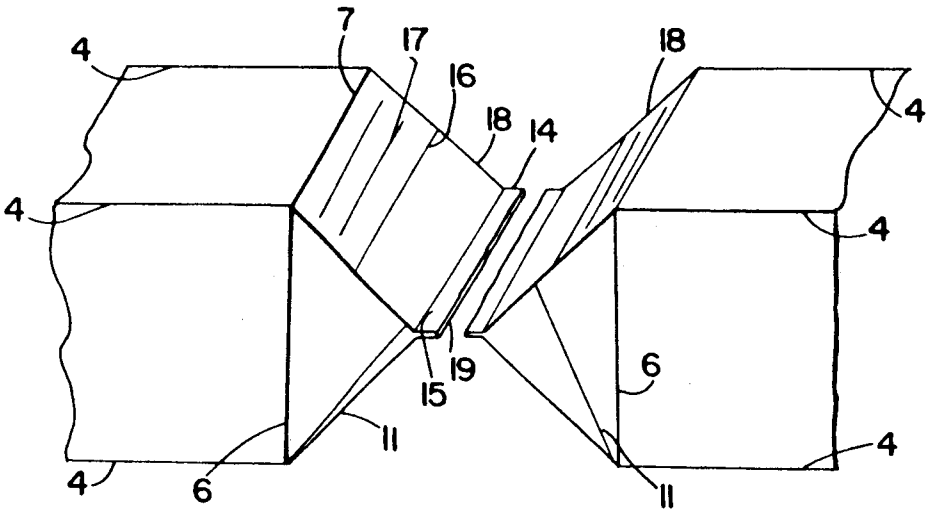
FIG. 9 shows two separated containers formed from the sheeting web.
Figure 10:
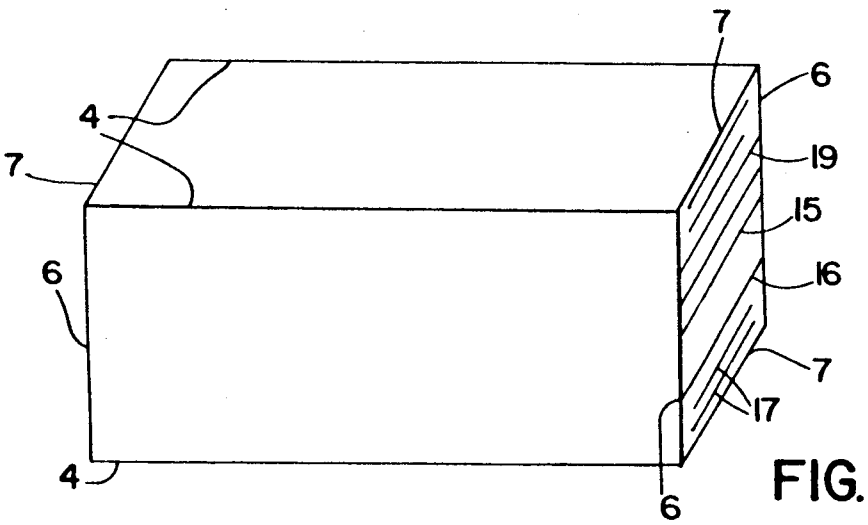
FIG. 10 shows one of the containers shown in FIG. 9 with the end zone pressed together.

In FIG. 9 the intermediate zone between two container zones is severed. Each individual container as illustrated in FIG. 10 is manufactured by this severing step. The container shown in FIG. 10 is completely coboid because its top zones are placed together and welded.

Figure 11:
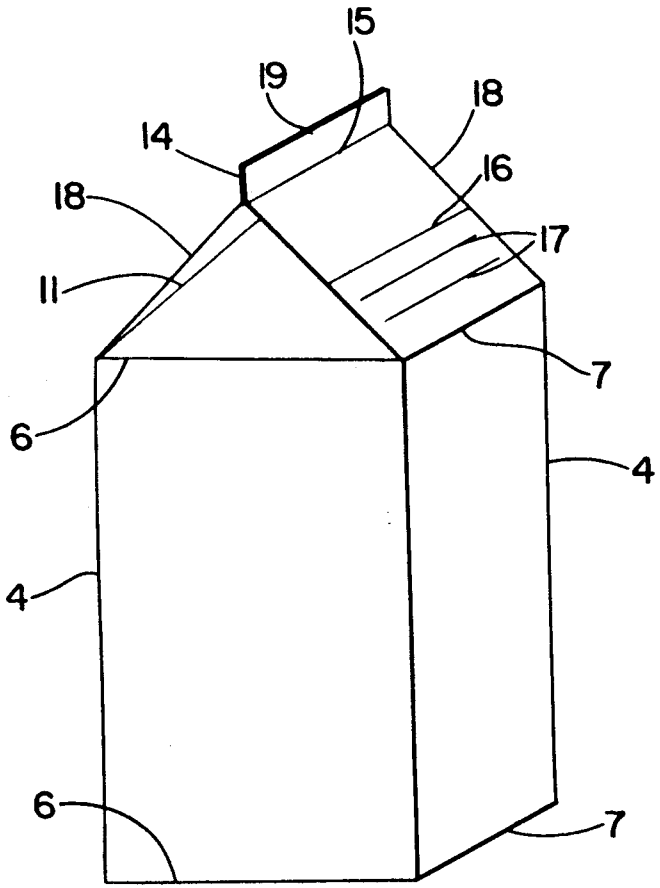
FIG. 11 shows one of the containers shown in FIG. 9 with the end zone unchanged.

In FIG. 11 only the lower end zone is welded to form a base. The upper end zone retains its roof-shaped configuration; this permits a particular appearance to be achieved; furthermore, the container shown in FIG. 10 is easy to pick up by hand.

Figure 12:
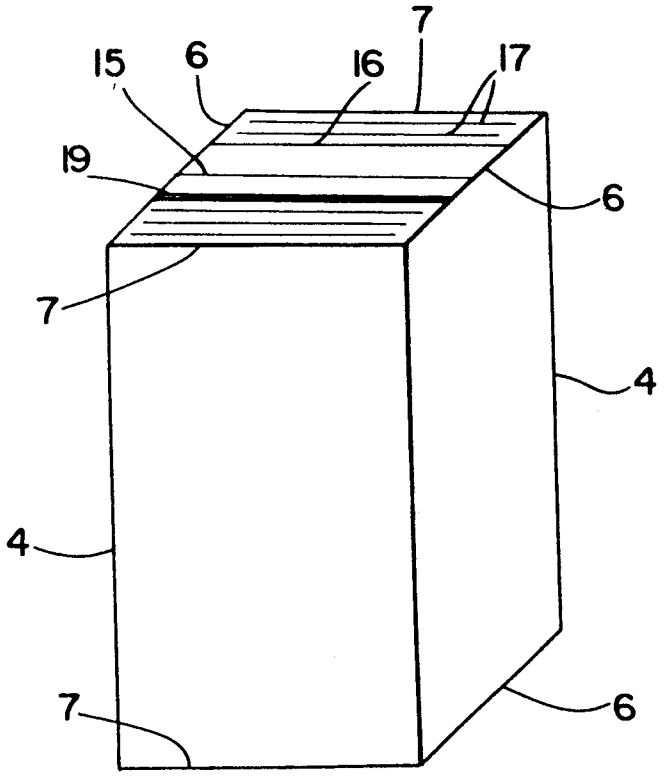
FIG. 12 shows a view corresponding to that of FIG. 10.

FIG. 12 shows a view corresponding to FIG. 10.

I claim:

1. Sheeting web for continuous packaging of a liquid product, which comprises (a) a sheet of foldable material having two parallel spaced longitudinal edges;

(b) at least four continuous longitudinal fold lines extending parallel to said longitudinal edges and uniformly spaced therefrom;

(c) continuous first transverse folds extending at right angles to said longitudinal edges (d) continuous second transverse folds located at a predetermined distance from and parallel to said first transverse folds, with the result so as to define four contiguous rectangles extending in a transverse direction and a rectangular end strip connected to one of said rectangles;

(e) where one of and the next-but-one of said rectangles, together with said rectangular end strip each have a third transverse fold extending parallel to said first transverse fold and equidistant therefrom, and each have a fourth transverse fold extending parallel to said second transverse fold and located at the same distance as said third transverse fold from said first transverse fold; and (f) said remaining two non-contiguous rectangles each have a central longitudinal fold located medially between said adjacent longitudinal folds and being shorter than the distance between said third and fourth transverse folds; and (g) said two remaining non-contiguous retangles further having four diagonal folds each running from the two opposite ends of said medially located longitudinal fold to the two nearest corners of said non-contiguous rectangles, said non-contiquous rectangles further having four inclined folds each extending from the two ends of said medial longitudinal fold to the nearest intersection of said third and fourth transverse folds with said longitudinal folds in said other rectangles or said end strip, said last mentioned diagonal folds each being oriented at an angle less than the angle of each said first mentioned diagonal folds.

2. Sheeting web for continuous packaging of a product, which comprises:

(a) a sheet of foldable material having parallel spaced longitudinal extending edges;

(b) four continuous fold lines extending longitudinally and parallel to said longitudinally extending edges;

(c) a plurality of continuous first transverse folds extending substantially transverse to said longitudinal edges, and a plurality of continuous second transverse fold lines extending parallel to said first transverse fold lines so as to define therewith four continuing contiguous rectangular portions extending across said sheet in a transverse direction and having a rectangular end strip connected to one of said rectangular portions;

(d) a least two non-contiguous rectangular portions each having a third fold line extending parallel to said first plurality of transverse fold lines, said third fold lines being spaced equally from said first plurality of fold lines, said non-contiguous rectangular portions further each defining a fourth transverse fold line equidistant from said second transverse fold lines as said third transverse fold lines from said first transverse fold lines;

(e) said two remaining non-contiguous rectangular portions each having a longitudinal fold line of length less than the longitudinal distance between said third and fourth fold lines and positioned medially between adjacent continuous longitudinally extending fold lines defining the respective rectangular portion;

(f) each said two remaining non-contiguous rectangular portions further having four diagonal fold lines, each extending from opposite ends of said medially positioned longitudinal fold lines to the nearest corner of said respective rectangular portion; and (g) each said two remaining non-contiguous rectangular portions further having four fold lines extending from said opposite end portions of said medially positioned longitudinal fold lines to the neareset intersection of said third and fourth transverse fold lines with said continuous longitudinal fold lines defining the next adjacent pair of rectangular portions and said end strip.

3. Sheeting web according to claim 2 wherein said sheet of foldable material is comprised of a first layer of foldable material and a second layer of material compatible with a predetermined product intended to come in contact therewith.

4. Sheeting web according to claim 3 wherein said first layer of foldable material is paper.

5. Sheeting web according to claim 3 wherein said first layer of foldable material is cardboard.

6. Sheeting web according to claim 4 wherein said second layer of material is aluminum.

7. Sheeting web according to claim 4 wherein said second layer of material is plastic.

8. Sheeting web according to claim 5 wherein said second layer of material is aluminum.

9. Sheeting web according to claim 5 wherein said second layer of material is plastic.

10. Sheeting web according to claim 6 wherein the end of said first layer is spaced inwardly of the edge of said second layer in the region of at least one longitudinal edge.

11. Sheeting web according to claim 7 wherein said second layer is folded upon itself to define a longitudinal edge.

* * * * *